US009267271B2

(12) United States Patent
Lu

(10) Patent No.: US 9,267,271 B2
(45) Date of Patent: Feb. 23, 2016

(54) FAUCET EXTENDER

(71) Applicant: PRINCE LIONHEART, INC., Santa Maria, CA (US)

(72) Inventor: Yafei Lu, Jiangsu (CN)

(73) Assignee: PRINCE LIONHEART INC., Santa Maria, CA (US)

( * ) Notice: Subject to any disclaimer, the term of this patent is extended or adjusted under 35 U.S.C. 154(b) by 242 days.

(21) Appl. No.: 14/020,290

(22) Filed: Sep. 6, 2013

(65) Prior Publication Data

US 2014/0305511 A1 Oct. 16, 2014

Related U.S. Application Data

(63) Continuation of application No. 29/452,459, filed on Apr. 16, 2013, now Pat. No. Des. 712,519.

(51) Int. Cl.
*E03C 1/04* (2006.01)

(52) U.S. Cl.
CPC ..... *E03C 1/0404* (2013.01); *Y10T 137/0402* (2015.04); *Y10T 137/9464* (2015.04)

(58) Field of Classification Search
CPC ..... E03C 1/0404
USPC ..... 137/801, 15.01; 4/675–678; 239/25, 239/211
See application file for complete search history.

(56) References Cited

U.S. PATENT DOCUMENTS

| | | | | |
|---|---|---|---|---|
| 3,462,080 | A * | 8/1969 | Demaree et al. | 239/27 |
| 7,588,197 | B2 * | 9/2009 | Finell | 239/289 |
| 8,276,615 | B2 * | 10/2012 | Weber | 137/625.46 |
| 8,366,019 | B2 * | 2/2013 | Lee | 239/211 |
| 9,044,765 | B2 * | 6/2015 | Lee | |
| 2006/0207670 | A1 * | 9/2006 | Peters | 137/801 |
| 2007/0175531 | A1 * | 8/2007 | Daniels | 137/801 |
| 2012/0180893 | A1 * | 7/2012 | Lee | 137/801 |

OTHER PUBLICATIONS

Written Opinion of the ISA for the corresponding PCT application PCT/US2014/034012.

* cited by examiner

*Primary Examiner* — Craig Schneider
*Assistant Examiner* — Joseph P Heil
(74) *Attorney, Agent, or Firm* — WPAT, P.C.; Anthony King

(57) ABSTRACT

A universal faucet extender having an attachment member and a trough member to detachably attach to faucet spigots or aerators of various designs. The universal faucet extender extends the flow of water within arms' reach to allow children and other individuals who would have difficulty to reach and access the flowing water. The attachment member comprises at least two receiving openings, a first receiving opening on a rear end of the attachment member and a second receiving opening on a top surface of the attachment member, both of which are adapted to interchangeably receive a circumference of a faucet spigot.

20 Claims, 14 Drawing Sheets

FAUCET EXTENDER

CROSS-REFERENCE TO RELATED APPLICATIONS

This application is related to the following application(s): (1) U.S. Design patent application Ser. No. 29/452,459, "Faucet Extender", filed Apr. 16, 2013. This application is incorporated by reference herein in its entirety.

Although incorporated by reference in its entirety, no arguments or disclaimers made in the related application apply to this application. Any disclaimer that may have and occurred or might occur during the prosecution of the above-referenced application is hereby expressly rescinded.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION (1) Field of the Invention

The field of the invention relates to faucet attachments, more particularly to faucet attachments that extend the flow of water to within arms' reach for those who otherwise would not be able to or would have difficulty to be able to access the flowing water.

(2) Description of Related Art Including Information Disclosed Under 37 CFR 1.97 and 1.98

Hygiene plays an important role in leading a healthy lifestyle, thus habits like washing hands on a regular basis play a large role in everyday life. It follows then that people need to access running water from a sink. However, young children, people with disabilities, people with dwarfism, people with physical ailments (i.e., back pain, joint pain, nerve pain/damage), and others may have difficulties with reaching running water from a faucet.

As a result, children and other such individuals need assistance for washing hands. Parents typically hoist children up to reach the running water; however, this runs the risk of a parent losing his/her grip and dropping the child or some adults may be unavailable or unable to assist. Others have the additional task to first climb up onto a stool; yet, stools are of varying heights and individuals may still have difficulties reaching for not being tall enough—not to mention, stools may be quite expensive. Furthermore, there is the danger of slipping or falling from the stool, and incurring injury and pain.

Additionally, there are products on the market adapted to attach to an existing faucet for extending the faucet water flow; however, none are entirely satisfactory. Some of the products are bulky and involve complex extension parts and screws. For instance, existing parts of a faucet fixture may have to be removed before installing an attachment device. Even more, other products involve the arduous and oftentimes more costly task of removing and replacing an entire faucet fixture. Even more, some faucet attachment products may be hard to clean and/or risk bacteria and mildew build-up.

Perhaps most importantly, such products are typically adapted specifically for attachment to conventional/standard faucet spigots. Thus, users having kitchens and bathrooms equipped with uniquely shaped faucet fixtures/spigot designs are left with the alternative, potentially riskier options to reach the running water. In addition, for some such as children, the faucet extending feature may only be needed for a short period of time, so convenient attachment and removal would be preferred. Accordingly, there is a continuing need for a faucet attachment that caters to the range of abovementioned needs.

There are also known faucet extenders with only one rear-facing opening for receiving the faucet spigot. These types of faucet extenders, however, do not cater to certain types of faucet spigot shapes and angles. Therefore, there remains to be a need for a faucet extender that can universally fit over a large variety of faucet spigot shapes and angles.

All referenced patents, applications and literatures are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The invention may seek to satisfy one or more of the above-mentioned desires. Although the present invention may obviate one or more of the above-mentioned desires, it should be understood that some aspects of the invention might not necessarily obviate them.

BRIEF SUMMARY OF THE INVENTION

It would be advantageous to remedy the deficiencies in the prior art and products on the market. Accordingly, the present invention is a faucet attachment device directed to provide individuals having difficulties reaching water flowing from a faucet with a safe, simple in structure, low-cost, and convenient means to reach running water without the inconvenience of additional assistance from another human being, without risking injury, and without the hassle and expense of installing and/or replacing typically bulky and costly attachments and fixtures. Furthermore, the instant invention while being simple in structure is configured so as to attach to an expansive variety of faucets of varying shapes, sizes, angles, and designs.

To achieve the advantages and objectives of the present invention, a preferred embodiment of the present invention provides a faucet attachment device that attaches to a faucet spigot via an attachment member, and a trough member coupled to the attachment member extends outwards, thereby extending the direction of the water flow away from the faucet spigot and within reaching distance towards the user. The attachment member bears two receiving openings adapted to interchangeably receive a circumference of said faucet spigot or an aerator (or other accessories connected to the spigot). Users have the option of attaching the faucet extender to the faucet via the first or second receiving opening, whichever is most compatible with the faucet spigot design.

In the preferred embodiment of the present invention, the first receiving opening is invaginated and located on the rear end of the faucet extender. The opening is adapted to frictionally engage around a circumference of the faucet spigot by receiving the faucet spigot through the invaginated opening. The second receiving opening is located on the top surface of the attachment member and is adapted to frictionally engage the faucet spigot (or aerator) by direct engagement with a circumference of a faucet outlet, wherein the faucet outlet is an aerator or a protrusion located at the tip of a faucet spigot through which water directly flows out of.

Further, it is contemplated that at least one of the first and second receiving openings are made of a flexible material so as to be adapted to deform and at least partially conform to a shape of the faucet spigot and/or faucet outlet. It is still further contemplated that the second receiving opening may be configured into a variety of shapes including but not limited to circular-shaped, oval-shaped, x-shaped, and asterisk-shaped openings. Also, the second receiving opening may be further formed with a flexible rim for further reinforcement when attached to a faucet outlet.

The structure of the faucet attachment device is formed so as to prevent retrograde water flow. The invagination of the first receiving opening is inwardly extended. Further contemplated is that the invagination has a closed shape/formation when the particular opening is not in use thereby preventing retrograde water flow. Also, the faucet extender facilitates forward water flow by using a flexible material in the attachment member so a weight of the trough member and/or the water causes the front end of the extender to tilt downwards.

A trough member is coupled to the attachment member and extends outwards towards the user. The rear end of the trough member is coupled to the front end of the attachment member. Upon attachment to the faucet spigot through either receiving opening of the attachment member, the water flows down onto and along the trough of the faucet extender away from the faucet spigot such that the user's reaching hands may access the flowing water with ease.

In some preferred embodiments the trough member is partially open, and the rear end of the trough member is coupled to the front end of the attachment member. The rear end of the trough member has sidewalls that taper downwards toward a front end of the trough member. In the alternative, the rear end of the partially open trough member has sidewalls that taper upwards toward a front end of the trough member. In another preferred embodiment, the rear end of the partially open trough member has sidewalls that remain at the same height throughout substantially an entire length of the trough member.

In another preferred embodiment, the sidewalls extend upwards and converge such that the trough member is partially enclosed while still allowing ingress and egress of water flowing from the faucet. Similarly, the circumference of the rear end of the trough member is coupled to the circumference of the front end of the attachment member.

When the faucet attachment device is no longer needed, the device can easily be removed by pulling the device off the faucet spigot.

Another aspect of the invention is directed to methods of universally extending a water flow away from faucet spigots of various designs allowing children and individuals having trouble reaching running water to reach the water flow with ease. This objective is achieved by: providing a faucet extender adapted to be detachably attached to a faucet spigot and/or aerator; providing a first receiving opening disposed on a rear facing side of the extender adapted to receive the spigot; providing a second receiving opening separate from the first receiving opening and disposed on a top-facing side of the extender adapted to receive the faucet outlet of the faucet spigot; providing a quick-release detachment mechanism such that a user may interchangeably use the first and second receiving openings to receive different spigots and/or aerators; and providing a channel outlet disposed on the front end of the faucet extender opposite the end of the first receiving opening, wherein the channel is adapted to direct the flow of water away from the spigot.

It is still further contemplated that at least one of the first and second receiving openings is made of a flexible material adapted to deform and partially conform to the shape of the spigot. Further contemplated is that at least one of the first and second receiving openings is adapted to make engaging and frictional contact with the spigot such that the contact is sufficient to hold a weight of the faucet extender.

Still further contemplated is to have a structure formation so as to prevent retrograde water flow. One embodiment is providing an inwardly extended invaginated opening as one of said first and second receiving openings to prevent retrograde flow. Another contemplated option is having at least one of said first and second receiving opening to have a closed formation when it has no portion of the spigot disposed therethrough. Further contemplated is to provide a flexible material in the attachment member so a weight of the trough member causes a front portion of the extender to tilt downwards, thus facilitating a forward fluid flow.

Various objects, features, aspects and advantages of the present invention will become more apparent from the following detailed description of preferred embodiments of the invention, along with the accompanying drawings in which like numerals represent like components. Consistent with the foregoing, the invention also contemplates associated apparatus and method embodiments.

BRIEF DESCRIPTION OF THE DRAWINGS

It should be noted that the drawing figures may be in simplified form and might not be to precise scale. In reference to the disclosure herein, for purposes of convenience and clarity only, directional terms, such as, top, bottom, left, right, up, down, over, above, below, beneath, rear, front, distal, and proximal are used with respect to the accompanying drawings. Such directional terms should not be construed to limit the scope of the invention in any manner. Referring to the drawings.

DETAILED DESCRIPTION OF THE INVENTION

The invention and its various embodiments can now be better understood by turning to the following detailed description of the preferred embodiments, which are presented as illustrated examples of the invention defined in the claims. It is expressly understood that the invention as defined by the claims may be broader than the illustrated embodiments described below.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed herein even when not initially claimed in such combinations.

Figure 1:
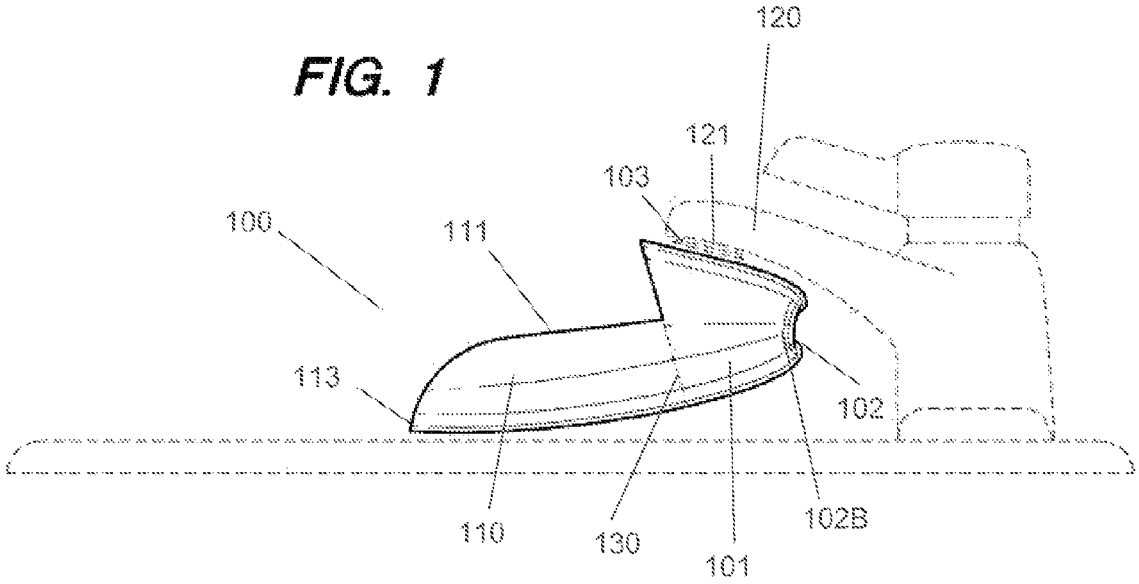
FIG. 1 is a side view of a first embodiment of a faucet extender of the present invention attached to a faucet outlet (e.g., an aerator) via a receiving opening on a top surface of the attachment member.

FIG. 1 illustrates an embodiment of a faucet attachment device 100 attached to an aerator/faucet outlet 121 of a faucet spigot 120. The embodiment of the faucet attachment device 100 is comprised of an attachment member 101 and a trough member 110. The adjoining area 130 is the location at which a front of the attachment member 101 and a rear of the trough member 110 are coupled together by commonly known manufacturing methods of similar products. The attachment member 101 is comprised of two receiving openings 102 103. A first receiving opening 102 is located at the rear end of the of the faucet attachment member 101. A second receiving opening 103 is located at the top surface of the attachment member 101. This depiction shows the second receiving opening 103 frictionally engaged with a circumference of a faucet outlet 121 of the faucet spigot 120, wherein the faucet outlet 121 is typically an aerator or a protrusion located at the tip of a faucet spigot 120 through which water directly flows out of.

Figure 2:
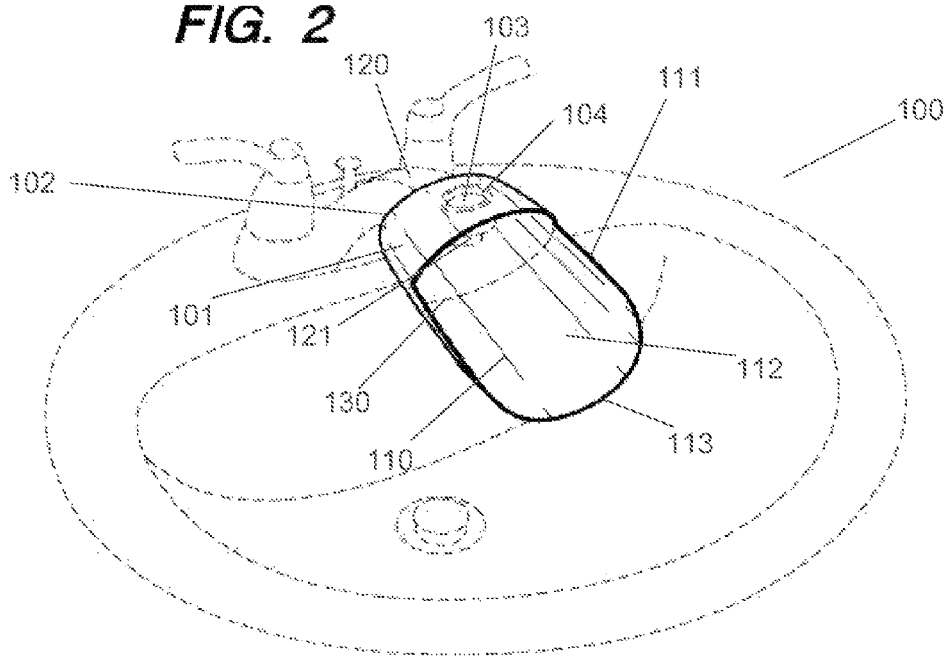
FIG. 2 is a top perspective view of the faucet extender of FIG. 1 attached to the same faucet via a different receiving opening located on a rear end of the attachment member.

FIG. 2 shows the same embodiment of the faucet attachment device 100 now attached to a circumference of a faucet spigot 120 via a different receiving opening. The faucet spigot 120 here is threaded through the first receiving opening 102 located at the rear end of the attachment member 101. The illustration depicts that the second receiving opening 103 located on the top surface of the attachment member 101 is not frictionally engaged with any circumference of the faucet spigot 120. In the present depiction, the trough member 110 has raised sidewalls 111 creating a channel 112 through which water flows down towards the exit 113. The present depiction is a partially open trough member 110 such that water from the faucet outlet 121 will flow downwards onto and along the trough member 110 towards the exit 113 and a user's outstretched hands. The partially open trough member 110 has raised sidewalls 111 that do not rise and converge to create an enclosed trough member.

In another embodiment, the trough member 110 may be fully enclosed allowing for ingress and egress of water flow. In an embodiment with a fully enclosed trough member 110, the sidewalls 111 would rise and converge thereby creating an enclosure, and water would still flow along the channel 112 towards the exit 113. A circumference of the rear end of the fully enclosed (not shown) or partially open trough member 110 can be coupled to a circumference of the front end of the attachment member 101 at the adjoining area 130.

In alternate embodiments, the trough member 110 and channel 112 may be configured to widen, to narrow, to maintain substantially the same width, to curve, to zigzag, to loop around, and to dip and rise depending on the desired application. Further, the trough member 110 and channel 112 may be any desired length. In alternate embodiments, the sidewalls 111 may have varying heights, shapes and sizes including but tapering downwards, tapering upwards, remaining at the same height, wavy, zigzag, etc. The trough member 110 may be made of metal, plastic, polyurethane, rubber, phosphorescent (i.e., glow in the dark, glow under ultraviolet light) and thermochromatic (i.e., color-changing, temperature sensitive) material or combination of materials that provide the strength, durability, waterproof, and any other desired physical and functional attributes. Additionally, it should be appreciated that the materials contemplated herein may be derivatized in numerous manners.

As discussed earlier, the attachment member 101 is comprised of at least two receiving openings 102, 103. The first receiving opening 102 located at the rear of the faucet attachment device 100 is adapted to receive a circumference of a faucet spigot 120. In the present embodiment, the first receiving opening 102 is an invagination. In other embodiments, the shape of the first receiving opening 102 can be a slit or a hole of varying shape and size adapted to receive a faucet spigot of varying shape and size. The second receiving opening 103 is adapted to receive a circumference of a faucet outlet 121 of a faucet spigot 120. In the present embodiment, the second receiving opening is a circular shape. In alternative embodiments, the second receiving opening 103 can be configured into an oval shape, X-shape, or asterisk-shape. In one embodiment, the circular shape is preferred to offer a snug fit over an aerator. In another embodiment, the X-shape is preferred as it fits over aerator of varied diameters. Additionally, the second receiving opening 103 may have an optional rim 104 of flexible material adapted to enhance frictional engagement with a faucet outlet 121.

The attachment member 101 comprised of at least two receiving openings 102, 103 may be made of a material or suitable combination of materials selected from a group consisting of thermoplastic elastomers (TPE), silicone, rubber, polyurethane, and plastic, whether they are molded, single-shot molded, injection molded, formed, compressed, etc. As those of ordinary skill in the art would recognize, TPE are a class of copolymers or a physical mix of polymers (typically plastic, rubber) which consist of materials with both thermoplastic and elastomeric properties. Still further contemplated alternative suitable materials may include phosphorescent (i.e., glow in the dark), thermochromatic (i.e., color-changing, temperature sensitive material). In alternate embodiments, the area surrounding the first and the second receiving openings 102, 103 may be made of a different material(s) such that the faucet spigot 120 and/or faucet outlet 121 can pass through the first and/or the second receiving openings 102, 103, and the different material(s) may be adapted to deform and at least partially conform to the shape of said faucet spigot 120 or faucet outlet 121.

The trough member 110 and attachment member 101 may be coupled at the adjoining area 130 with an adhesive, or any other known means of affixing the components together. Another embodiment has the attachment member 101 and trough member 110 made of the same material and integral to each other.

The contemplated faucet attachment device 100 can universally attached to faucets of various designs. FIGS. 1 and 2 show the same style of faucet capable of using the faucet attachment device 100 both ways. One of ordinary skill in the art would immediately recognize that there are faucets that are angled differently and would only fit through one of the two receiving openings of the faucet attachment device 100. This makes the contemplated invention very versatile.

Figure 3:
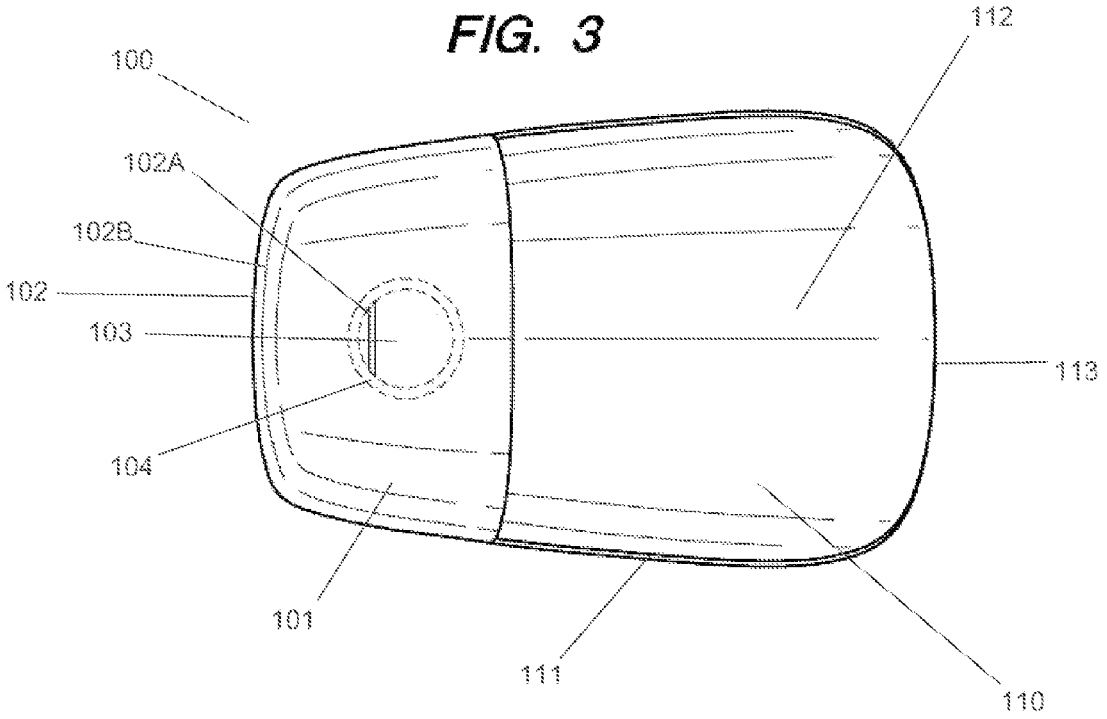
FIG. 3 is a top view of the faucet extender of FIG. 1.

FIG. 3 shows a top view of the faucet attachment device 100. The attachment member 101 is illustrated having two receiving openings 102, 103. In the present embodiment, the first receiving opening 102 is invaginated, and the inner lip 102A of the invaginated receiving opening can be seen peeking through the second receiving opening 103. The invagination of the first receiving opening 102 can be shallow or deep. Preferably, it is inwardly extended by at least 1.0 centimeter, more preferably, at least 0.2 centimeter, or most preferably, at least 0.5 centimeter. The inward extension prevents retrograde water flow.

The second receiving opening 103 has a rim 104 that can be thinner, thicker, or of a different flexible material to better facilitate attachment and frictional engagement with a faucet outlet 121.

Figure 4:
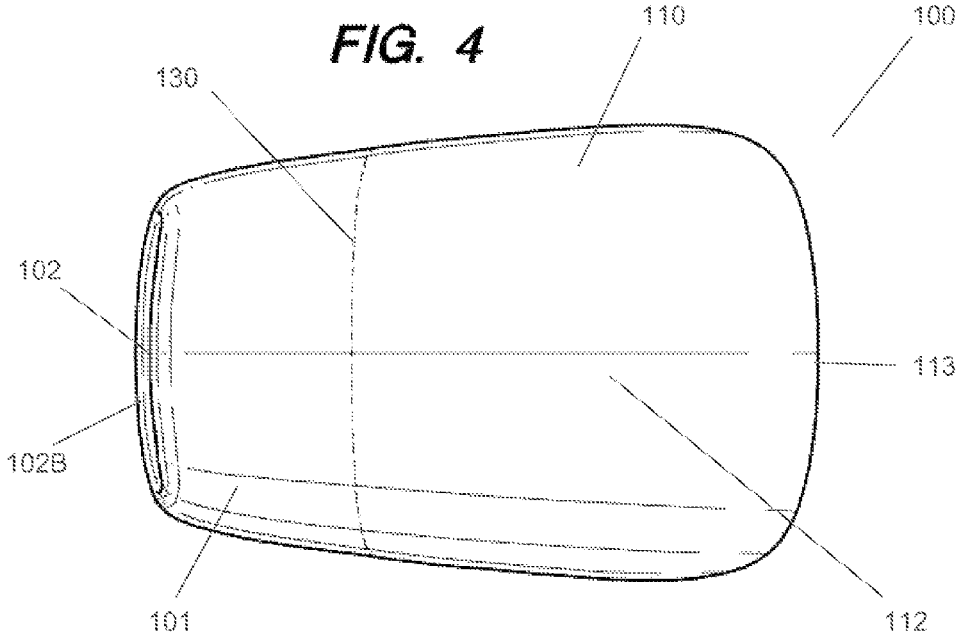
FIG. 4 is a bottom view of the faucet extender of FIG. 1.

FIG. 4 shows a bottom view of the faucet attachment device 100. Depicted here is the outer lip 102B of the invaginated first receiving opening 102. Further, the adjoining area 130 shows the area at which the attachment member 101 and rear portion of the trough member 110 are coupled together.

Figure 5:
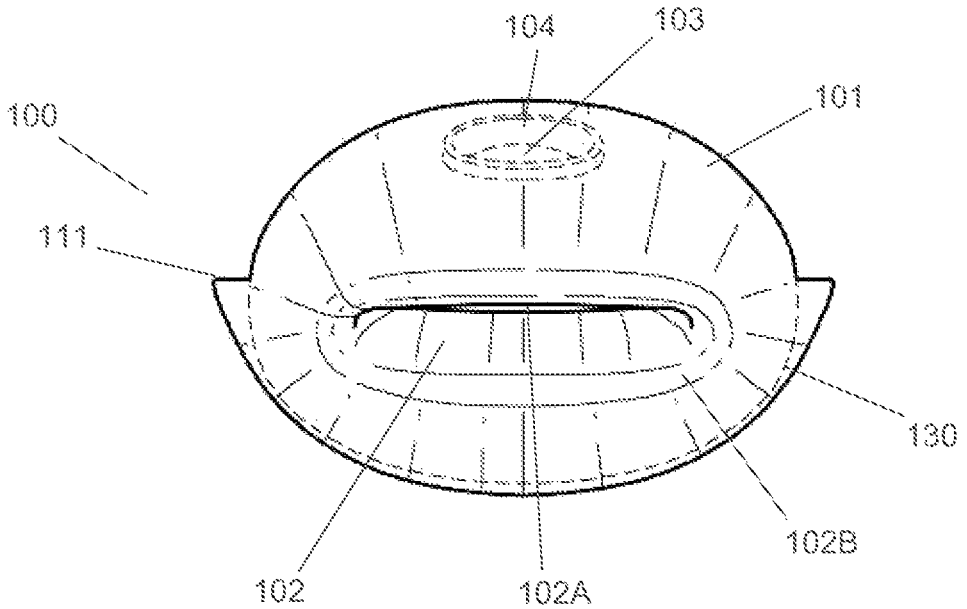
FIG. 5 is a back view of the faucet extender of FIG. 1.

FIG. 5 shows a back view of the faucet attachment device 100. Here, the invaginated first receiving opening 102 is depicted with an outer lip 102B that curves inwards. Having the infolded material of the invagination provides for greater surface area for contact and frictional engagement between the first receiving opening 102 of the attachment member 101 and a circumference of a faucet spigot. In addition, the invaginated opening 102 is inwardly extended forming an infolded structure. The invagination terminates at an inner lip 102A. The second receiving opening 103 is depicted as a circular opening with a thicker rim 104 to engage a faucet outlet.

Figure 6:
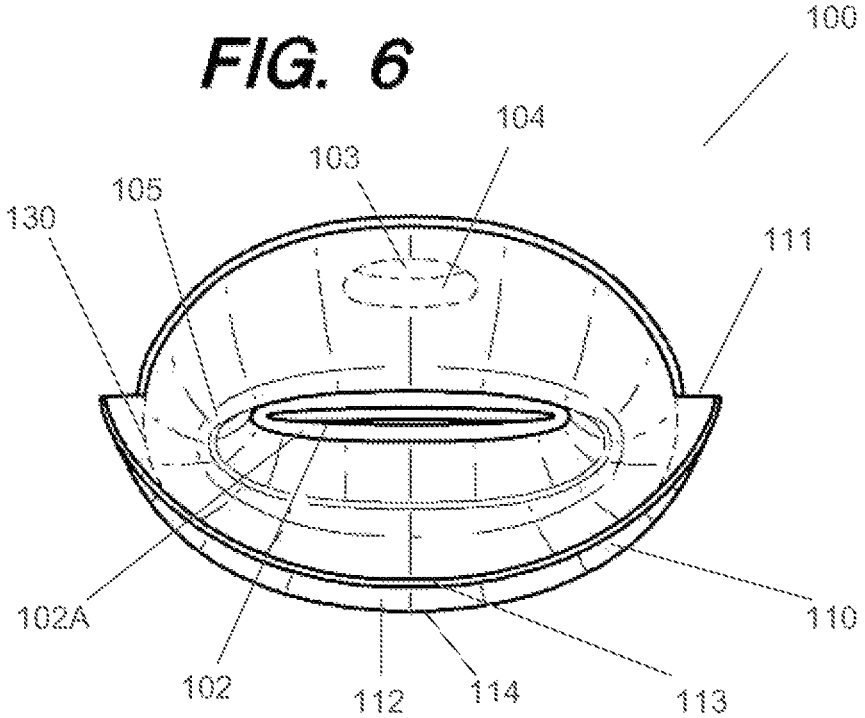
FIG. 6 is a front view of the faucet extender of FIG. 1.

FIG. 6 shows a front view of the faucet attachment device 100. Here, the inner lip 102A of the invaginated first receiving opening 102 is depicted. Typically, a faucet spigot will be threaded through the first receiving opening 102 and said opening can engage a circumference of the faucet spigot. Inner lip 102A are shown in FIG. 6 as being slightly open. In some other embodiments, the inner lip 102A can be fully sealed unless a faucet spigot is disposed therethrough.

Also, in this embodiment, when the faucet attachment device 100 is placed on a flat surface, from the front view, the trough member 110 can be seen as having a slight concave structure as only the deep point 114 of the trough member 110 would touch a flat surface.

As mentioned earlier, one contemplated structure of the faucet attachment device 100 is formed so as to prevent retrograde water flow. First, the first receiving opening 102 can be formed so as to maintain a closed formation (fully sealed) when not in use. Most preferably, the closed formation is a slit or hole in which the lips meet when the first receiving opening 102 is not in use. Second, the inner fold 105 of the invaginated opening prevents retrograde flow of water. In the event that flowing water flows towards the rear of the faucet extender, the water will encounter the inner fold 105 and then result in forward flow towards the front exit 113 of the faucet attachment device 100. Thirdly, when attached to a faucet spigot 120 or a faucet outlet 121, the faucet attachment device 100 tilts or slants downward to facilitate forward water flow. The downward tilt of the faucet attachment device 100 is attributed in part to having a flexible material of the attachment member 101 and maintaining a heavier weight towards the front half of the faucet attachment device 100.

The trough member 110 is coupled to the attachment member 101 at the adjoining area 130. In this depiction, the trough member is configured such that when water flow travels along the channel 112, there is a slight dip towards a deep point 114 and then a slight rise towards the exit 113 of the trough member 110.

Figure 7:
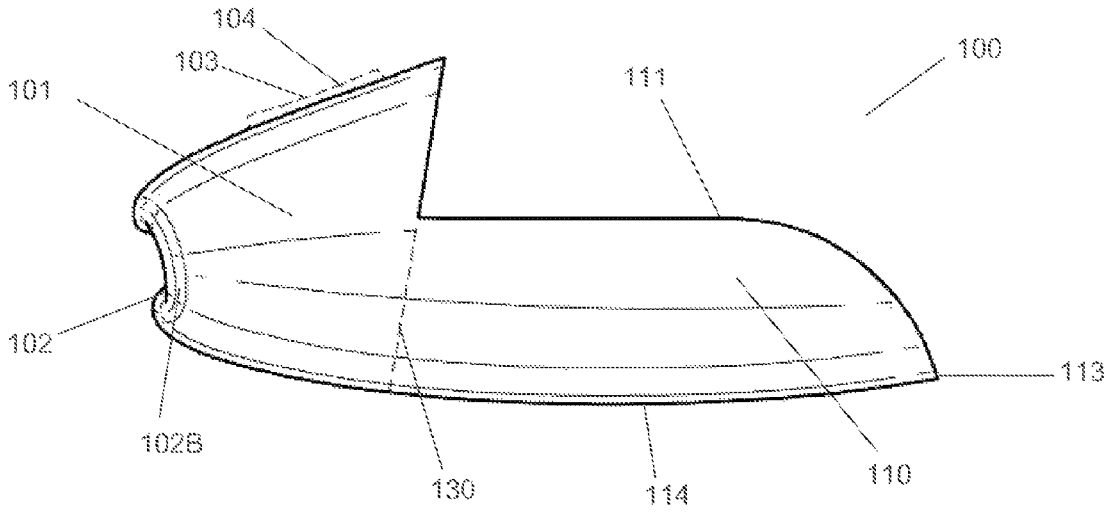
FIG. 7 is a side view of the faucet extender of FIG. 1.
Figure 8:
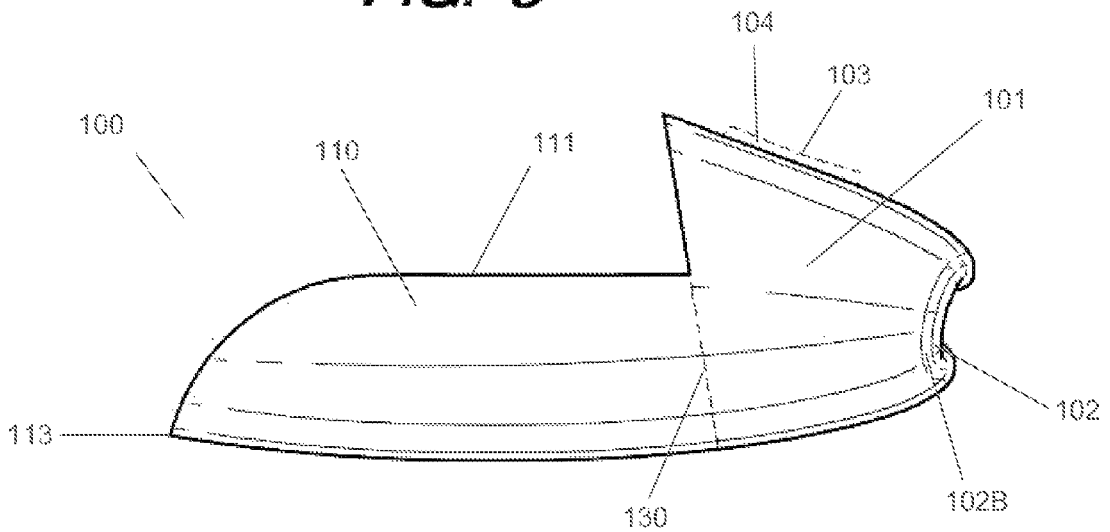
FIG. 8 is a side view of the faucet extender of FIG. 1.

FIG. 7 and FIG. 8 depict side views of the faucet attachment device 100. Here, the outer lip 102B of the invaginated first receiving opening 102 can be seen at the rear of the attachment member 101. From these side views, the embodiment further depicts the second receiving opening 103 having a rim 104 that protrudes outwards. Alternatively, the rim 104 may only protrude inwards, protrude both inwards and outwards, or no rim at all. The protruding rim 104 allows for greater surface area through which the second receiving opening 103 may frictionally engage a faucet outlet. The side views show the concave structure in which there is slight dip in the trough member 110 towards a deep point 114 and then a rise towards the exit 113 of the trough member. This arrangement is preferred as it minimizes splatter. In this embodiment, the trough member has an open trough member 110 with sidewalls 111 that remain at the same height throughout substantially an entire length of the trough member 110. Having sidewalls 111 that remain at the same height throughout substantially an entire length of the trough member 110 form a channel 112 for the water stream to remain at a relatively constant width as it flows towards the exit 113 of the trough member. In addition the sidewalls 111 are able to minimize water splatter off the sidewalls 111 of the trough member 110.

Figure 9:
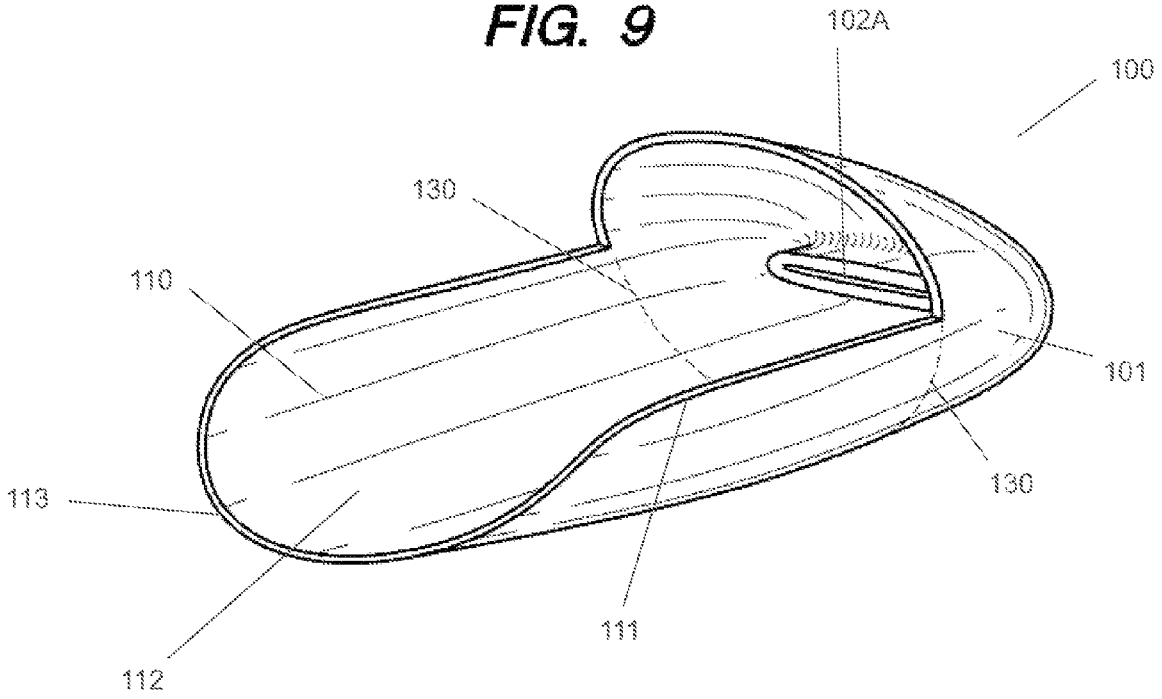
FIG. 9 is a front and side perspective view of the faucet extender of FIG. 1, showing the inwardly extended invaginated opening. Here, the invaginated opening is not completely sealed shut.
Figure 10:
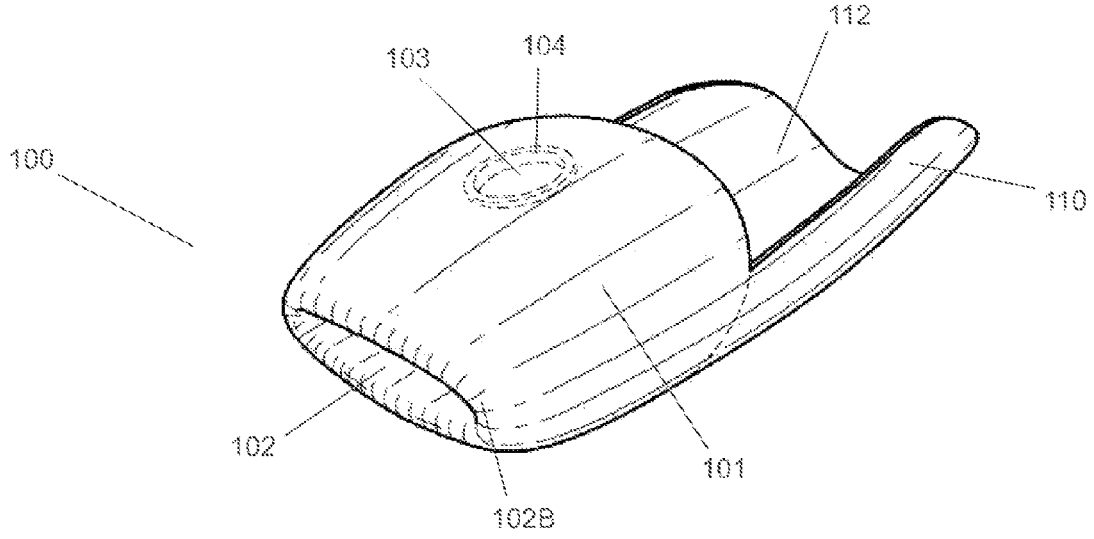
FIG. 10 is a back and side perspective view of the faucet extender of FIG. 1.

FIG. 9 depicts a front and side angled perspective view of the faucet attachment device 100. FIG. 10 depicts a back and side angled perspective view of the faucet attachment device 100. The raised sidewalls 111 provide for the channel 112 along which water flow travels along towards the exit 113 of the trough member 110. In alternate embodiments, the sidewalls 111 can be higher or lower so long as an adequate channel 112 is formed along which water may flow; also, the sidewalls 111 can be raised and converged creating a fully enclosed (not shown) or partially open trough member 110.

Figure 11:
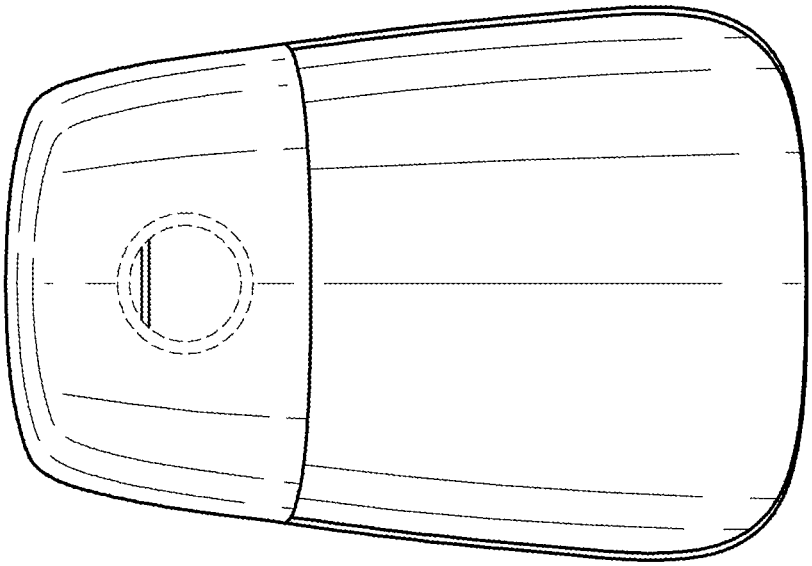
FIG. 11 is a top view of a second embodiment of the faucet extender of the present invention where the side walls of its trough member have a different configuration.
Figure 12:
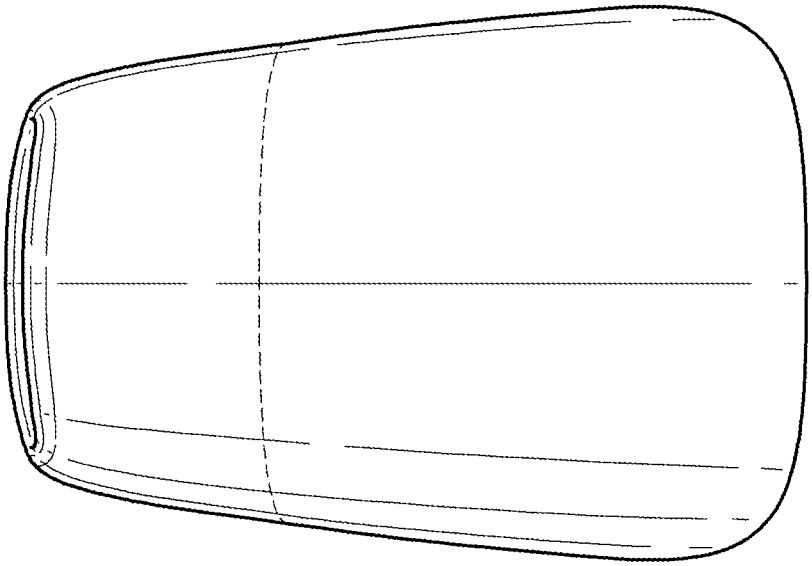
FIG. 12 is a bottom view of the faucet extender of FIG. 11.
Figure 13:
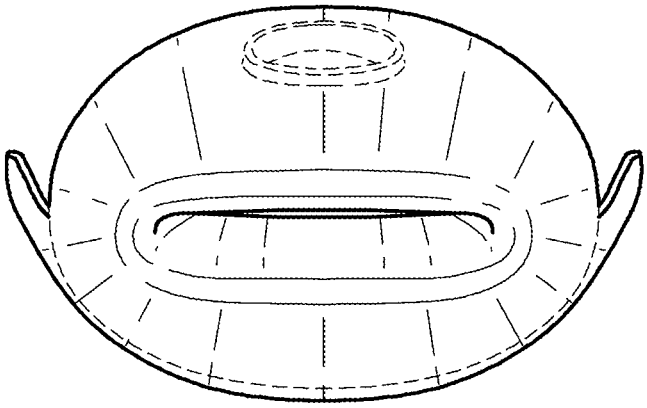
FIG. 13 is a back view of the faucet extender of FIG. 11.
Figure 14:
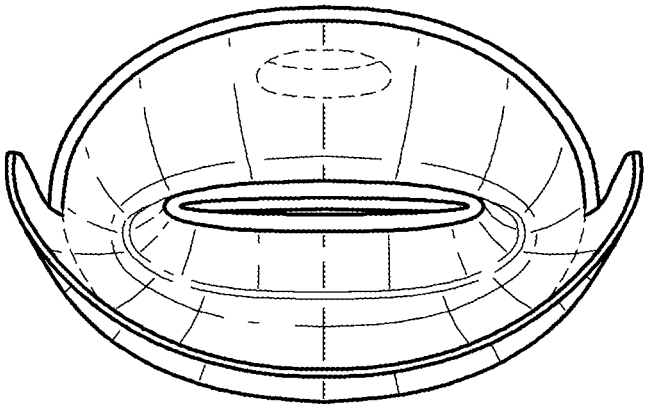
FIG. 14 is a front view of the faucet extender of FIG. 11.

FIGS. 11 and 12 depict the top and bottom views respectively of a second embodiment of the faucet attachment device 100. FIGS. 13 and 14 depict the back and front views respectively of the second embodiment of the faucet attachment device 100. In FIG. 13, the back view shows the sidewalls 111 towards the front end exit 113 of the trough member 110 can be seen, from the back view, protruding on both the left and right sides such that the sidewalls 111 and trough member 110 slightly widen/flare outwards.

Figure 15:
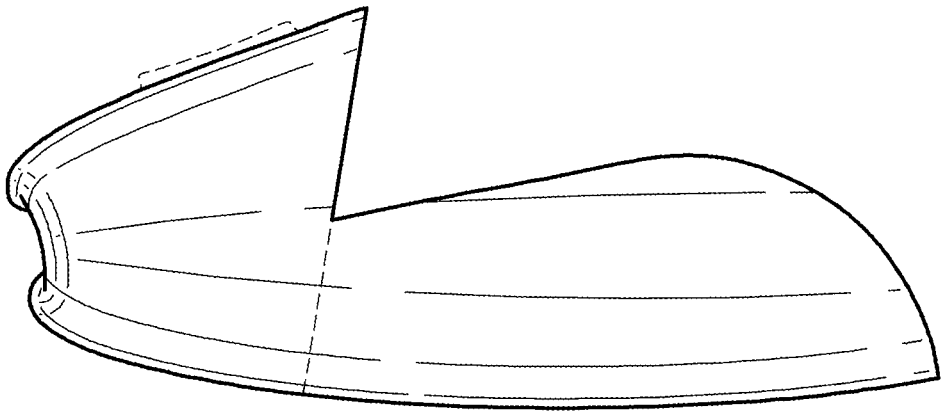
FIG. 15 is a side view of the faucet extender of FIG. 11, showing sidewalls with increasing height towards the front direction.
Figure 16:
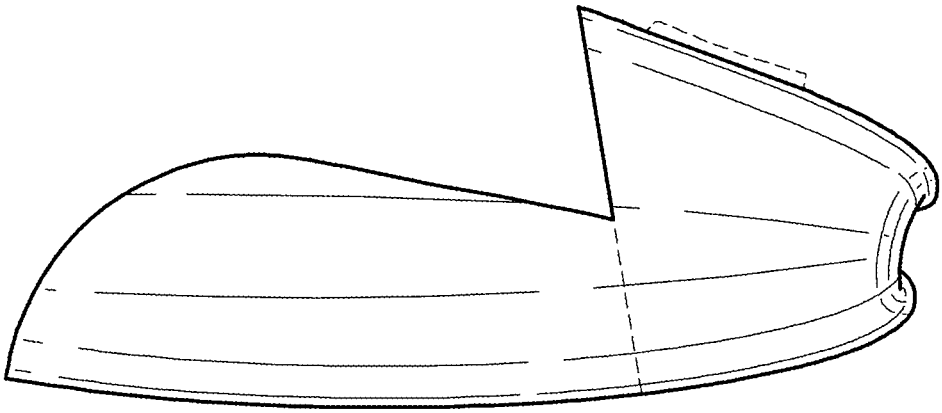
FIG. 16 is a side view of the faucet extender of FIG. 11.

FIGS. 15 and 16 depict the side views of the second embodiment of the faucet attachment device 100. Here, the trough member 110 is open, and the sidewalls 111 taper upwards toward a front end of the trough member 110. Sidewalls 111 that taper upwards toward a front end of the trough member 110 ensure minimal water splatter off the sides of the trough. Further, the raised side walls facilitate a relatively narrower channel of water stream along the trough member 110.

Figure 17:
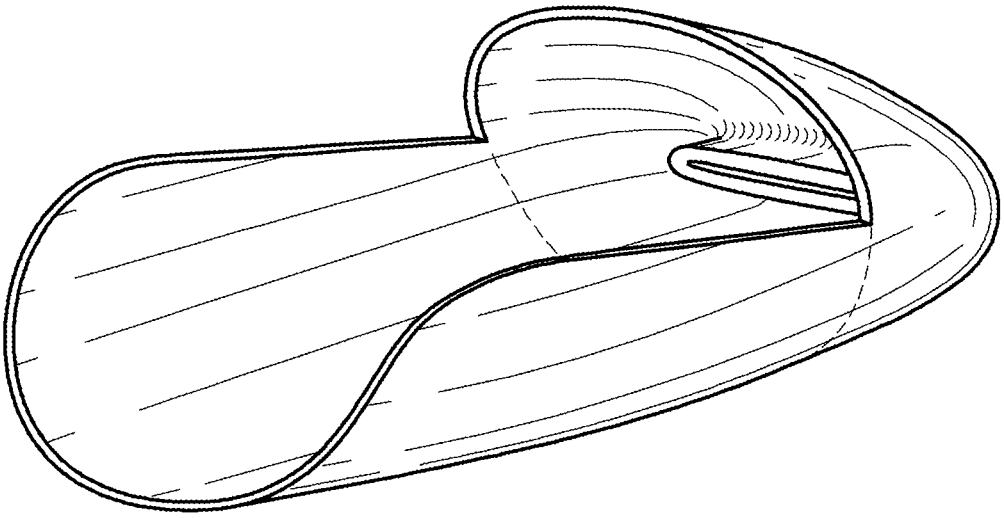
FIG. 17 is a front and side perspective view of the faucet extender of FIG. 11.
Figure 18:
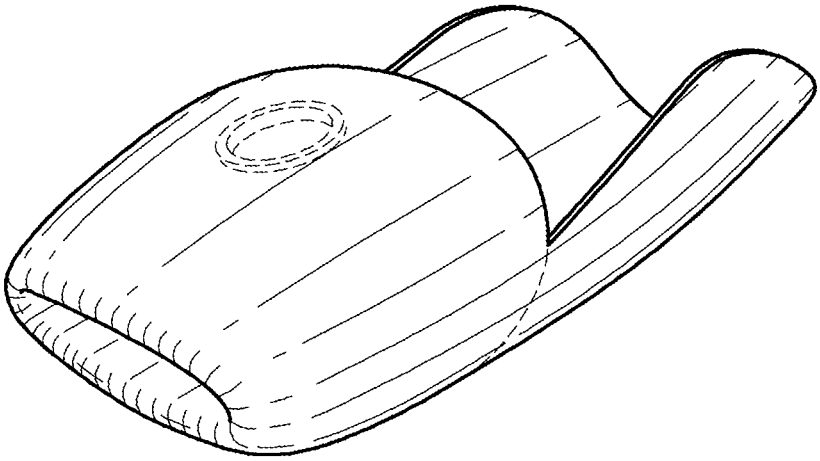
FIG. 18 is a back and side perspective view of the faucet extender of FIG. 11.

FIG. 17 depicts a front and side angled perspective view of the faucet attachment device 100. FIG. 18 depicts a back and side angled perspective view of the faucet attachment device 100. The invaginated opening is shown in FIG. 17 as being inwardly extended. The distance from the outer lip 102B to the inner lip 102A, as discussed earlier, is preferably at least 0.5 cm.

Figure 19:
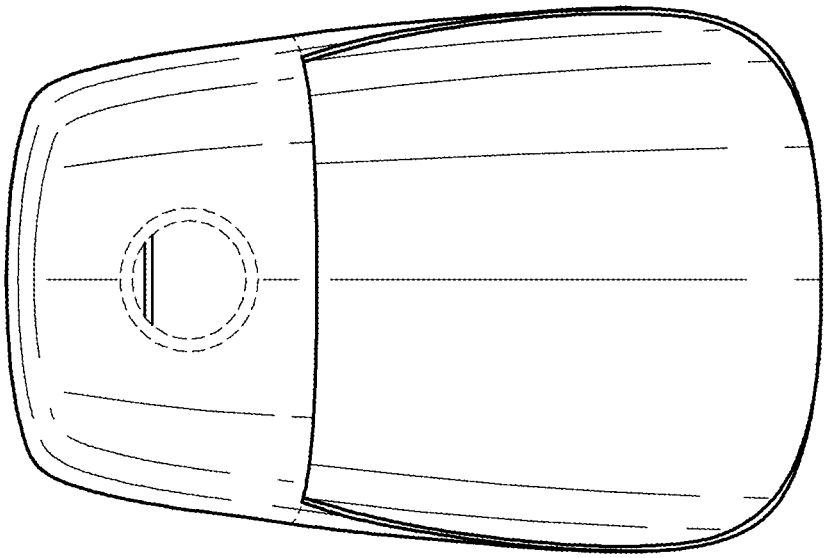
FIG. 19 is a top view of a third embodiment of the faucet extender of the present invention where the side walls of its trough member have a different configuration.
Figure 20:
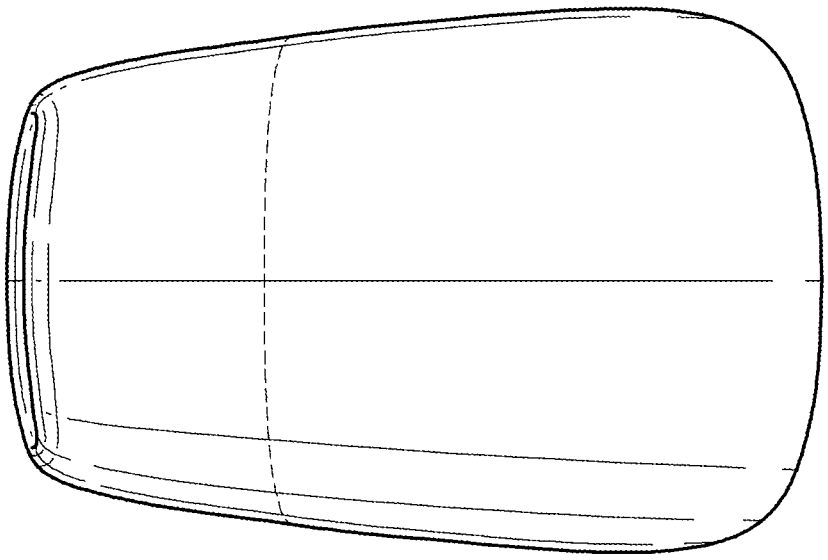
FIG. 20 is a bottom view of the faucet extender of FIG. 19.
Figure 21:
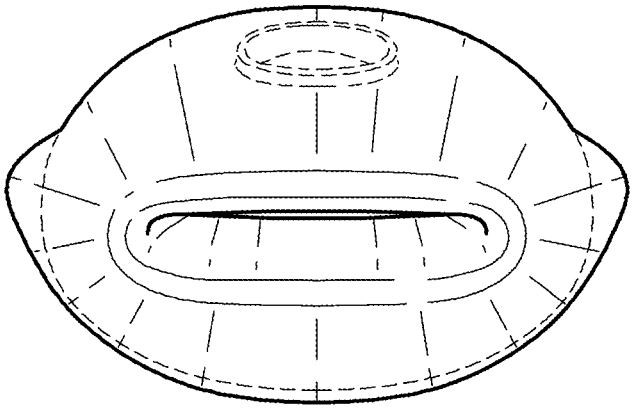
FIG. 21 is a back view of the faucet extender of FIG. 19.
Figure 22:
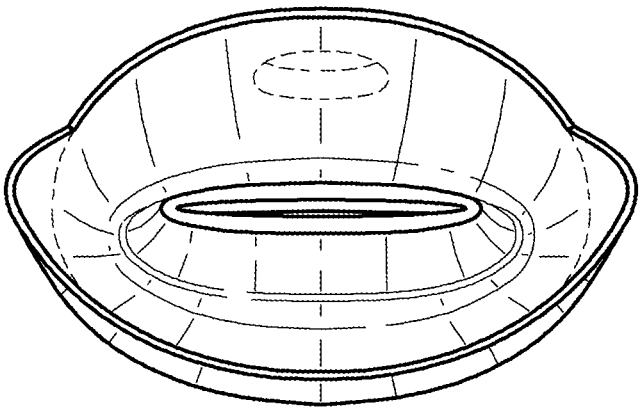
FIG. 22 is a front view of the faucet extender of FIG. 19.

FIGS. 19 and 20 depict the top and bottom views respectively of a third embodiment of the faucet attachment device 100. FIGS. 21 and 22 depict the back and front views respectively of the third embodiment. Here, the trough member 110 is configured differently and the silhouette differs from the embodiments shown in FIGS. 5, 6, 13 and 14.

Figure 23:
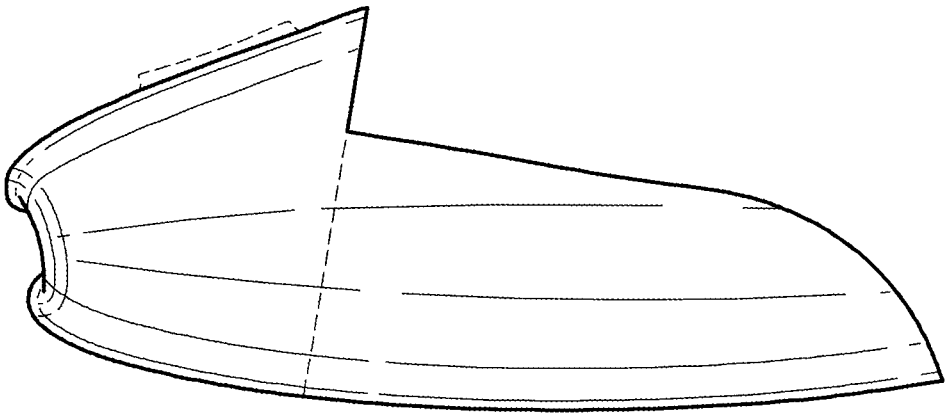
FIG. 23 is a side view of the faucet extender of FIG. 19, showing sidewalls with decreasing height towards the front direction.
Figure 24:
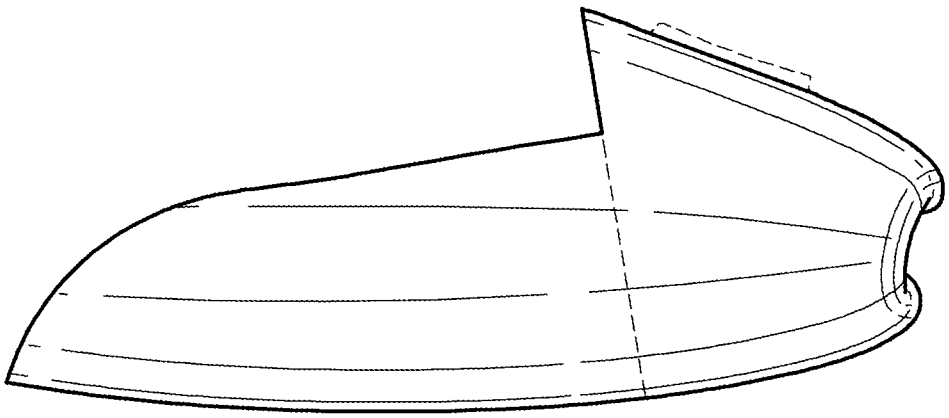
FIG. 24 is a side view of the faucet extender of FIG. 19.

FIGS. 23 and 24 depict the side views of the third embodiment of the faucet attachment device 100. Here, the trough member 110 is again open and the sidewalls 111 taper downwards toward the front end of the trough member 110. Some may prefer a widened stream as opposed to a narrow concentrated fluid stream. Having sidewalls 111 that taper downwards toward the exit 113 of the trough member 110 facilitate a widened fluid stream as the water travels down and along the trough member 110.

Figure 25:
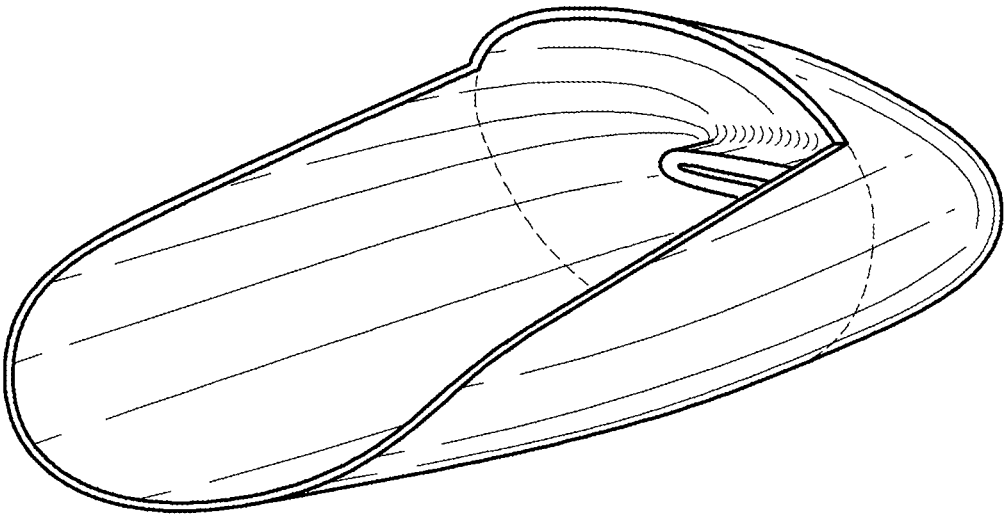
FIG. 25 is a front and side perspective view of the faucet extender of FIG. 19.
Figure 26:
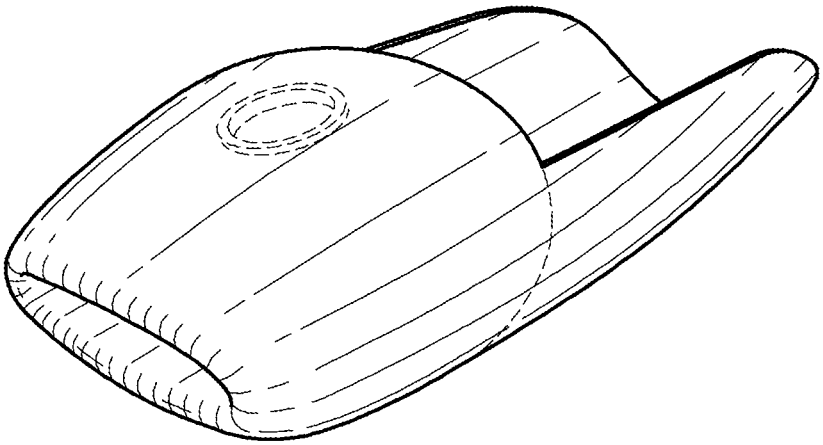
FIG. 26 is a back and side perspective view of the faucet extender of FIG. 19.

FIG. 25 depicts a front and side angled perspective view of the faucet attachment device 100. FIG. 26 depicts a back and side angled perspective view of the faucet attachment device 100.

Figure 27:
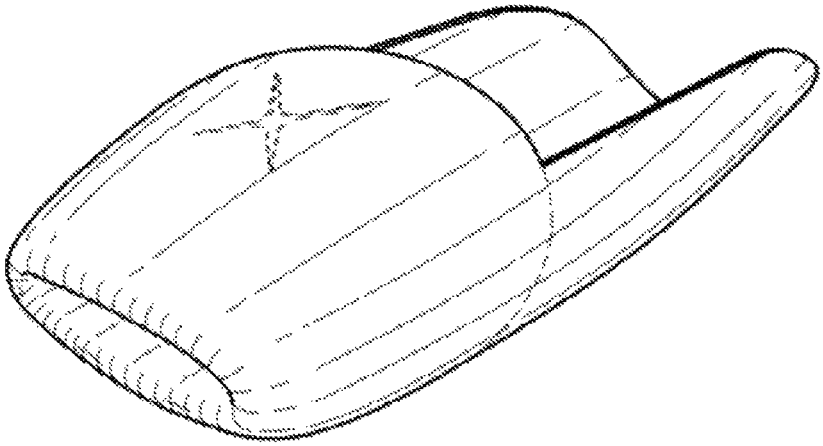
FIG. 27 shows another embodiment where a receiving opening on a top surface of the attachment member has an X-shape.

FIG. 27 depicts a back and side angled perspective view of the faucet attachment device 100 having an X-shaped second receiving opening.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Thus, specific embodiments and applications of the faucet extender have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the invention. In addition, where the specification and claims refer to at least one of something selected from the group consisting of A, B, C . . . and N, the text should be interpreted as requiring only one element from the group, not A plus N, or B plus N, etc.

What is claimed is:

1. A faucet extender to direct a water flow from a faucet spigot, the faucet extender comprising:

an attachment member to engage the faucet spigot;

a trough member coupled to said attachment member; and wherein the attachment member comprises a first receiving opening on a rear end of the attachment member and a second receiving opening on a top surface of the attachment member, both of which are adapted to interchangeably receive either a circumference of said faucet spigot or a circumference of an aerator attached on said spigot, wherein water flows downwards onto and along the trough member towards an exit when either the first receiving opening or the second receiving opening of the attachment member is utilized.

2. The faucet extender of claim 1, wherein the first receiving opening is an invagination.

3. The faucet extender of claim 1, wherein the second receiving opening has a flexible rim.

4. The faucet extender of claim 2, wherein the invagination is inwardly extended by at least 0.5 cm thereby preventing a retrograde water flow.

5. The faucet extender of claim 4, wherein the invagination prevents retrograde flow by having a closed shape when said spigot is not inserted through the first receiving opening.

6. The faucet extender of claim 3, wherein the faucet extender facilitate forward flow by using a flexible material in the attachment member such that a front end of the extender tilts downwards as a result of at least one of a weight of the trough member and a weight of water flow.

7. The faucet extender of claim 3, wherein the flexible rim is configured into a circular or oval shape.

8. The faucet extender of claim 3, wherein the flexible rim is configured into either an X-shape or an asterisk shape.

9. The faucet extender of claim 1, wherein the partially open trough member has a rear end with sidewalls that taper downwards toward a front end of the trough member.

10. The faucet extender of claim 1, wherein the partially open trough member has a rear end with sidewalls that taper upwards toward a front end of the trough member.

11. The faucet extender of claim 1, wherein the partially open trough member has a rear end with sidewalls that remain at the same height throughout substantially an entire length of the trough member.

12. The faucet extender of claim 3, wherein the attachment member is made of a material selected from a group consisting of thermoplastic elastomers (TPE), silicone, rubber, polyurethane, and plastic.

13. The faucet extender of claim 12, wherein the trough member is made of at least one material selected from a group consisting of metal, plastic, polyurethane, rubber, phosphorescent and thermochromatic material.

14. The faucet extender of claim 3, wherein the attachment member and the trough member are made of the same material and are integral to each other.

15. A method of universally extending a water flow away from faucet spigots of various designs, said method comprising:

providing a faucet extender having a trough member coupled to an attachment member, the trough member having an outlet;

providing a first receiving opening disposed on a rear-facing side of the attachment member adapted to detachably receive a first faucet spigot; and providing a second receiving opening separate from the first receiving opening and disposed on a top-facing side of the attachment member adapted to receive either a second faucet spigot or an aerator attached on said second faucet spigot, such that when the faucet extender is removed from the first faucet spigot, the second receiving opening can receive said second faucet spigot or said aerator, and wherein the water flow from the second faucet spigot is directed entirely to pass through the trough member and to the outlet, and not to pass through the first receiving opening.

16. The method of claim 15, further comprising the step of providing at least one of said first and second receiving opening to be made of a flexible material such that a rim of such opening made of flexible material is adapted to deform and at least partially conform to a shape of either the first or the second faucet spigot.

17. The method of claim 16, further providing that a rim of each of said first and second receiving opening is adapted to make engaging and frictional contact with said spigot such that the engaging and frictional contact is sufficient to hold a weight of the faucet extender and a flowing water.

18. The method of claim 17, further providing an invaginated opening as one of said first and second receiving openings to prevent retrograde flow, wherein the invaginated opening is inwardly extended by at least 0.5 cm.

19. The method of claim 18, wherein the invaginated opening has a closed formation when it has no portion of the first or second spigot disposed therethrough.

20. The method of claim 17, further providing a flexible material in the attachment member of the faucet extender such that the outlet tilts downward by at least one of a weight of the trough or the weight of the flowing water.

* * * * *